United States Patent [19]

O'Sullivan

[11] Patent Number: 4,723,760

[45] Date of Patent: Feb. 9, 1988

[54] PICKET FENCE ASSEMBLY

[76] Inventor: William O'Sullivan, 619 Parkview Ave., Penndel, Pa. 19047

[21] Appl. No.: 49,572

[22] Filed: May 14, 1987

[51] Int. Cl.[4] ..... B21F 27/00

[52] U.S. Cl. ..... 256/22; 256/67; 256/65

[58] Field of Search ..... 256/67, 65, 22, 21

[56] References Cited

U.S. PATENT DOCUMENTS

| | | | |
|---|---|---|---|
| 2,563,530 | 8/1951 | Hawkins | 256/21 |
| 2,590,929 | 4/1952 | Bush | 256/22 |
| 3,067,985 | 12/1962 | Cusack | 256/22 |

*Primary Examiner*—Andrew V. Kundrat
*Attorney, Agent, or Firm*—Robert J. Mooney

[57] ABSTRACT

An adjustable fence assembly is disclosed constructed in sections having at least a pair of vertically oriented end posts for establishing the location of a respective section in the ground. Intermediate the end posts, a plurality of tubular pickets are mounted in a substantially vertical direction upon a series of tubular rails horizontally oriented and pivotally mounted between the end posts. Each rail is fabricated having a plurality of paired openings spaced apart along the length of the rail and corresponding in number to that of the pickets. Vertically aligned on opposite sides of each rail, both of the paired openings are shaped to accept and hold a respective one of the pickets with one of the openings being additionally formed to provide an apertured flap interior to the rail. The aperture in each flap is adapted to accept a rod extended longitudinally through each rail to interlock the rail with a crossing picket. Acting as a hinge-like member, the flap permits the interlock between the rail and crossing picket to be angularly adjustable upon the rod so that the fence assembly may be racked as a whole.

8 Claims, 4 Drawing Figures

PICKET FENCE ASSEMBLY

BACKGROUND OF THE INVENTION

The present invention relates to fence construction and more particularly to an improved picket fence assembly wherein the crossing members thereof are interiorally joined in a novel manner so as to provide an angularly adjustable or "rackable" structure.

Adjustable picket fences are those wherein the substantially horizontal crossing members of the fence, called rails, are capable of being disposed at a plurality of angles with respect to the substantially vertical crossing members, called pickets. Equipped with such an angularly adjustable feature, sometimes referred to as "rackable," this type of picket fence can be utilized both on level ground and on various degrees of sloping terrain.

Numerous designs for adjustable picket fences have been proposed and developed, including those constructed of hollow or tubular crossing members. While such existing adjustable fence designs have been generally satisfactory in providing a reasonable range of angular adjustability or "rackability," their structural means of interconnecting the adjustable crossing members have been somewhat complicated comprising various moving parts and, as a result, have presented some difficulties in handling and mechanically assembling of the crossing members at the locations where the fences are to be installed.

SUMMARY OF THE INVENTION

Accordingly, it is a general purpose and object of the present invention to provide an improved picket fence assembly having a wide range of angular dispositions for use on various slopes of terrain.

A more particular object of the present invention is to provide an adjustable picket fence assembly wherein the crossing members are more easily handled and simply interconnected than in similar type fences heretofore provided.

A further object of the present invention is to provide a rackable picket fence that is sturdy in its construction yet aesthetically pleasing in its appearance.

A still further object of the present invention is to provide an adjustable picket fence assembly that is simple to fabricate and easy to assemble either in a remote workshop or at the immediate location where it is to be installed.

Briefly, these and other objects of the present invention are accomplished by an adjustable fence assembly constructed in sections having at least a pair of vertically oriented end posts for establishing the location of a respective section in the ground. Intermediate the end posts, a plurality of tubular pickets are mounted in a substantially vertical direction upon a series of tubular rails horizontally oriented and pivotally mounted between the end posts. Each rail is fabricated having a plurality of paired openings spaced apart along the length of the rail and corresponding in number to that of the pickets. Vertically aligned on opposite sides of each rail, both of the paired openings are shaped to accept and hold a respective one of the pickets with one of the openings being additionally formed to provide an apertured flap interior to the rail. The aperture in each flap is adapted to accept a rod extended longitudinally through each rail to interlock the rail with a crossing picket. Acting as a hinge-like member, the flap permits the interlock between the rail and crossing picket to be angularly adjustable upon the rod so that the fence assembly may be racked as a whole.

For a better understanding of these and other aspects of the present invention, reference may be made to the following detailed description taken in conjunction with the drawing in which like reference numerals denote like parts throughout the respective figures.

DESCRIPTION OF THE PREFERRED EMBODIMENT

Figure 1:
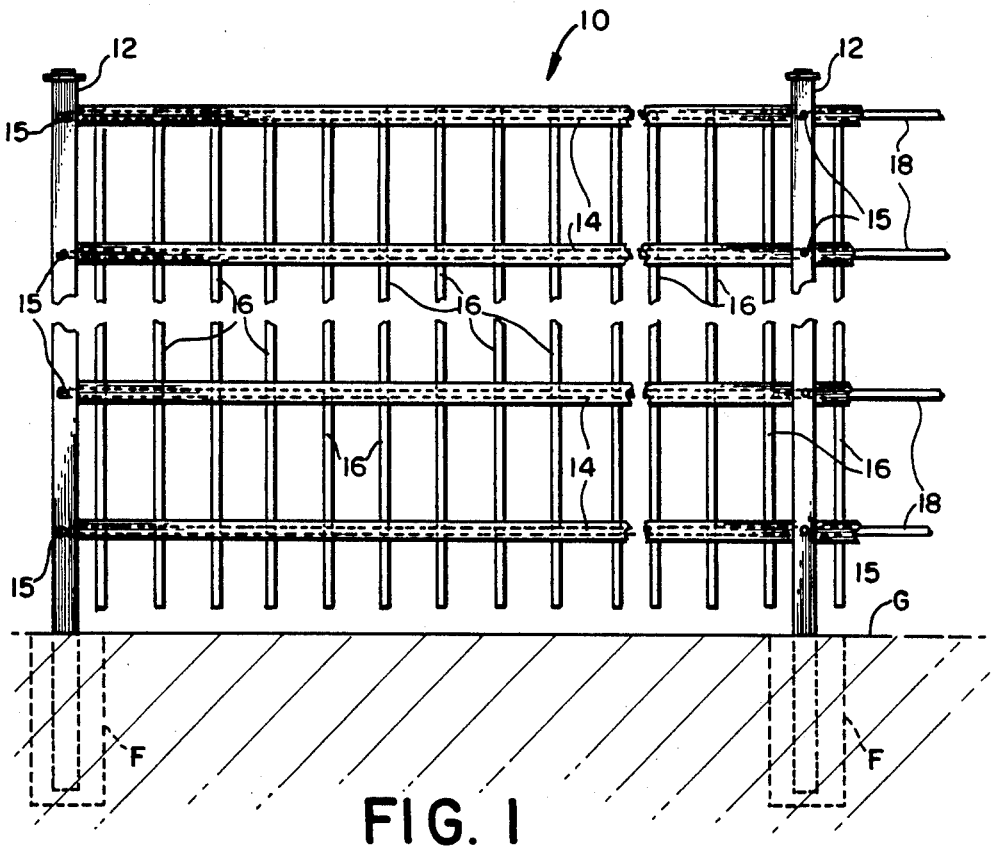
FIG. 1 is a side elevational view, partially broken, showing a section of the fence assembly according to the present invention.

Referring now to FIG. 1, a section of a fence assembly 10 comprised and constructed in accordance with the present invention is shown established in an erect position on a grade G that is substantially level. Each section of fence assembly 10, which may typically extend about six feet in length, includes two or more end posts 12 of a tubular construction intended to be fixed in a substantially vertical position by setting the bottom of each post in a concrete footing F or other similar foundation a certain distance below the grade G. The posts 12 are formed to provide a series of lateral openings shaped and sized to accept the ends of a corresponding series of tubular rails 14 horizontally but adjustably set between the posts. Each rail 14 is similarly formed having a rectangular cross-section that allows the ends of each rail to fit securely into the lateral openings of the end posts 12 thereby restricting axial rotation of the rail. Held in such position within end posts 12, the respective ends of each rail 14 are adapted to be pivotally connected to the end posts, typically by means of riveting, so that the rails may be moved at a variety of angles with respect to the end posts substantially in the plane of the fence assembly section 10. To accommodate for such riveting, the ends of each rail 14 are pierced transversely therethrough and the side walls of each end post 12 similarly pierced in a direction perpendicular to the line of each rail at corresponding positions alongside the series of lateral openings in the posts. With the pierced portions of the rail 14 and end post 12 properly aligned, a tubular rivet 15 of sufficient length may be inserted therethrough and secured therein by conventional means to afford pivotal coupling of the rail and post members.

Figure 2:
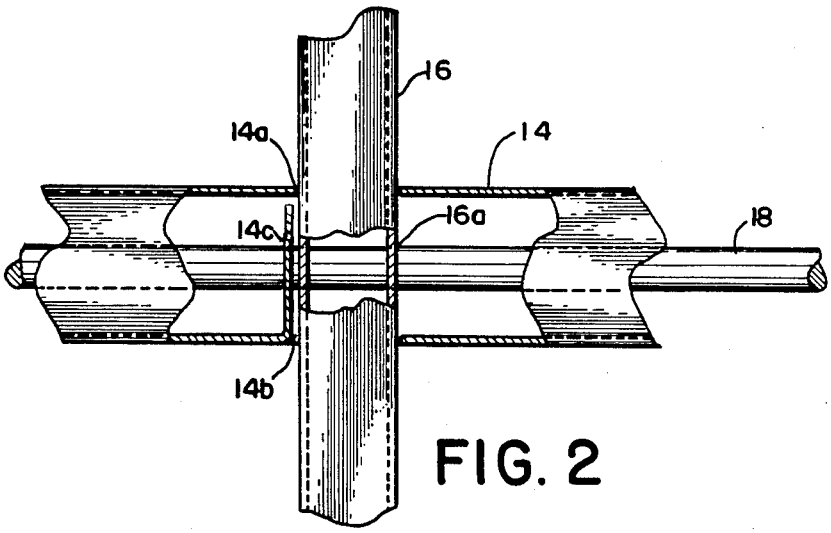
FIG. 2 is an enlarged view, partly in section, showing the interlocking area of the fence assembly of FIG. 1.

As described in greater detail hereinbelow in reference to FIGS. 2–4, each of the series of tubular rails 14 is further fabricated to provide a plurality of rectangular openings **14*a* and 14*b* formed in vertically aligned pairs along the length of the rails for mounting therein a corresponding plurality of tubular pickets 16 in vertical directions between the end posts 12. The pickets 16 are each similarly formed having a rectangular cross-section adapted to fit securely into and through the paired openings 14*a* and 14*b* of each of the series of rails 14 so that the pickets may be stationed along the rails in substantial vertical alignment with each other and without any axial rotation thereof. A series of lateral openings 16a, better shown in FIG. 2, are further provided along the height of each of the tubular pickets 16, each of the lateral openings being sized and circularly shaped to accept a corresponding rod 18 extended longitudinally through each of the rails 14 for the purpose of providing an adjustable interlock between the rails and crossing pickets in accordance with the present invention. It should be understood that the number and location of the lateral openings 16a corresponds with the number and location of the series of rails 14 as horizontally disposed between end posts 12**.

Figure 3:
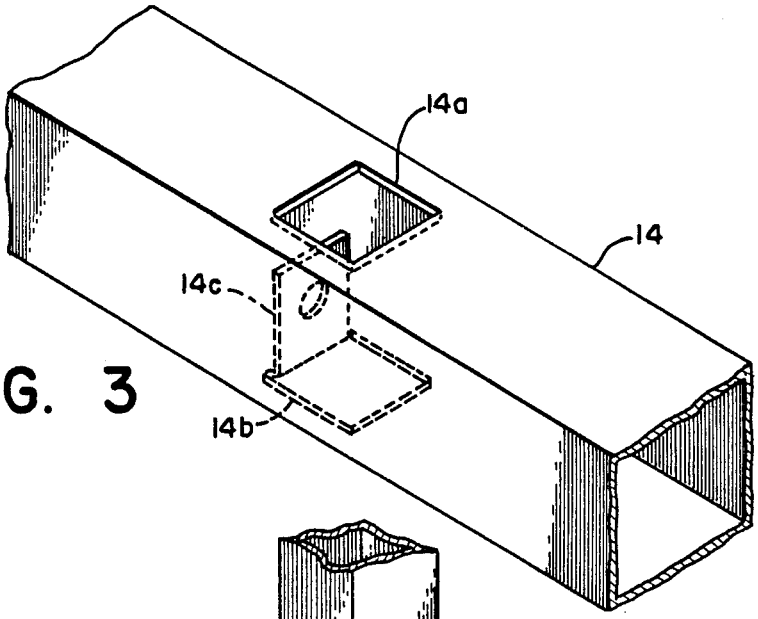
FIG. 3 is a perspective view of a portion of a rail showing one set of its paired openings including an associated apertured flap.
Figure 4:
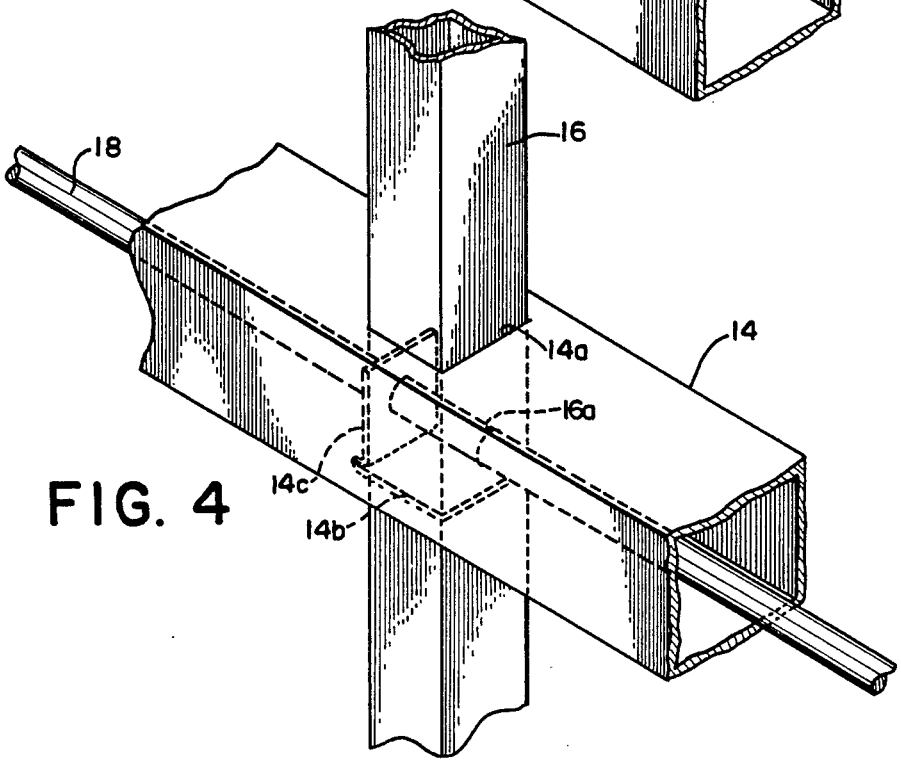
FIG. 4 is a perspective view of the crossing members of the fence assembly shown interlocked in accordance with the present invention.

Referring now to FIGS. 2–4 in conjunction with FIG. 1, each tubular picket 16 is mounted in like fashion to the crossing series of rails 14, the picket being extended through paired openings 14a and 14b and interlocked with the rail by means of transverse passage of rod 18 through lateral opening 16a. Joinder of the picket 16 to each crossing rail 14 is completed by the engagement of the rod 18 with an apertured flap 14c, best viewed in FIG. 3, which is transversely formed within the interior of each rail in connection with one of its paired openings.

The flap 14c is fabricated of a rigid but bendable material and may be formed directly from the associated opening 14a or 14b, typically by piercing of the upper or lower side of rail 14. Each flap 14c thus formed acts like a hinge allowing the flap to be internally disposed at a substantially perpendicular attitude relative to the side walls of the rail 14 as well as at slight angles, typically about 10°–15°, in either direction therefrom. The aperture formed in each flap 14c is centrally positioned and shaped to accept rod 18 freely therethrough as the rod extends through the respective rail 14. The aperture may be circular in shape or formed in the shape of an oval having its longitudinal axis running in a substantially vertical direction within the respective flap 14a of rail 14 so that the rod 18 engaged therein may move freely in upward and downward directions. With the picket 16 therefore properly positioned having its lateral opening 16a aligned with the aperture of flap 14c, rod 18 may be extended through rail 14 to engage both the lateral opening and the apertured flap and thereby interlock the rail with its crossing picket throughout the section of fence assembly 10. Acting like a hinge-like member, apertured flap 14c cooperates and adjusts with movements of rod 18 to permit the interlock between the respective rail 14 and crossing picket 16 to be angularly adjustable to a maximum of 45° so that the section of fence assembly 10 may be racked as a whole and adjusted in its fence line for variations in terrain.

Assembly of an individual fence section 10 should proceed in accordance with following procedure. Firstly, all of the rails 14 of each fence section 10 are collectively stacked in an upright arrangement having their rectangular openings 14a and respective flaps 14c in vertical alignment. Individual tubular pickets 16 are then inserte vertically into and through the corresponding rectangular openings 14a in the upright arrangement of rails 14, and one of the rods 18 is then inserted longitudinally through the bottom one of the rails and the corresponding lateral openings in the pickets 16. The remaining rails 14 in the upright arrangement are then separately placed into vertical position upon the pickets 16 and the corresponding rod 18 is inserted therethrough to interlock the crossing members. It should be noted that this stage of assembly of fence section 10 consisting of the complete set of crossing rails 14 and pickets 16 interlocked by rods 18 may be assembled at the field site or pre-assembled at a remote station and delivered as a racked whole to the site.

Before proceeding to complete the assembly and erection of the fence section 10 at the immediate site, one of the end posts 12 should be firmly established in a substantially vertical position with its lower end set in footing F. Corresponding ends of the series of rails 14 contained in the described pre-assembled stage may then be inserted into the lateral openings of the established end post 12 and pivotally connected thereto by riveting or other similar means. The remaining end post 12 should then be positioned loosely in its designated footing F opposite from the established post to allow for lateral insertion and pivotal connection of the corresponding ends of rails 14 before finally setting the post in its footing.

Therefore, it is apparent that the disclosed invention provides an improved picket fence assembly that is rackable having a wide range of angular dispositions for use on various slopes of terrain. More particularly, the disclosed invention provides an adjustable picket fence assembly with improved means of interlocking its crossing members for easier handling and greater rackability that picket fence assemblies heretofore provided. Furthermore, the disclosed picket fence assembly provides a fence section that is sturdy in construction yet aesthetically pleasing in its appearance. In addition, the described adjustable picket fence assembly is simple to fabricate and easy to assemble either in a remote workshop or at the immediate location where it is to be installed.

Obviously, other embodiments and modifications of the present invention will readily come to those of ordinary skill in the art having the benefit of the teachings presented in the foregoing description and drawings. It is therefore to be understood that various changes in the details, materials, steps and arrangement of parts, which have been described and illustrated to explain the nature of the invention, may be made by those skilled in the art within the principle and scope of the invention as expressed in the appended claims.

I claim:

1. A picket fence comprising:

at least two post members vertically aligned and spaced apart;

a plurality of tubular picket members vertically oriented and mounted intermediate said post members;

a series of tubular rail members extended in parallel between said post members and pivotally connected thereto, each of said rail members having a plurality of paired openings spaced apart along the length thereof to accept said picket members for mounting and a corresponding plurality of apertured flaps hingedly disposed within each of said rail members transversely between paired openings; and a series of elongated rod members extended longitudinally through respective ones of said rail members to engage said picket members and said apertured flaps, each of said rod members being transversely formed to move freely in upward and downward directions within said flap thereby interiorally joining said rail members and said picket members in a crossing relationship at a selectively adjustable angle.

2. A picket fence according to claim 1 wherein each of said flaps is integrally formed in connection with one of said paired openings, extending substantially across the section of the respective rail member.

3. A picket fence according to claim 2 wherein said flap is provided with an aperture circular in shape.

4. A picket fence according to claim 2 wherein said flap is provided with an aperture in the shape of an oval having its longitudinal axis extending between paired openings in a substantially vertical direction within said rail members.

5. In an adjustable fence assembly of the type wherein a plurality of tubular rails and pickets are mounted together in a crossing relationship at a selectively adjustable angle, the improvement comprising:

said rails each being formed to provide a plurality of paired openings aligned on opposite sides of said rail and spaced apart along the length thereof to accept therethrough the plurality of said pickets for mounting, each of said paired openings having an apertured flap hingedly disposed therebetween interiorally of said rail; and a plurality of elongated rods each extended longitudinally through respective ones of said rails to engage said pickets and said apertured flaps, each of said rods being transversely formed to move freely in upward and downward directions within said flaps thereby adjustably interlocking said rails and said pickets.

6. The improvement according to claim 5 wherein each of said flaps is integrally formed in connection with one of said paired openings, extending substantially across the section of the respective one of said rails.

7. The improvement according to claim 6 wherein said flap is provided with a circular aperture.

8. The improvement according to claim 6 wherein said flap is provided with an aperture in the shape of an oval having its longitudinal axis extending in a substantially vertical direction within said rails.

* * * * *